United States Patent [19]

Le Pierres

[11] 4,016,799

[45] Apr. 12, 1977

[54] SHOCK ABSORBER FOR FIREARMS AND THE LIKE

[75] Inventor: Gildas Le Pierres, La Ferte Alais, France

[73] Assignee: International Vibration Engineering, Boutigny-sur-Essonne, France

[22] Filed: Feb. 26, 1975

[21] Appl. No.: 553,157

[30] Foreign Application Priority Data

Feb. 27, 1974 France ..... 74.06614
Sept. 17, 1974 France ..... 74.31379

[52] U.S. Cl. ..... 89/42 B; 89/44 R
[51] Int. Cl.[2] ..... F41F 19/00
[58] Field of Search ..... 89/42 B, 44 R, 37 GM, 89/43 R

[56] References Cited

UNITED STATES PATENTS

| | | | |
|---|---|---|---|
| 988,776 | 4/1911 | Haussner | 89/44 R |
| 1,072,350 | 9/1913 | Müller | 89/42 B |
| 1,896,454 | 2/1933 | Marek | 89/44 R |
| 2,249,310 | 7/1941 | Braun et al. | 89/42 B |
| 3,783,738 | 1/1974 | Pelat | 89/44 R |

*Primary Examiner*—David H. Brown
*Attorney, Agent, or Firm*—Brisebois & Kruger

[57] ABSTRACT

A shock absorber for automatic weapons of the kind where all the shots in a burst with the exception of the first are fired during the return movement to the initial position of the weapon. The weapon has a recoil member movable with respect to a fixed member to absorb the impact and resilient restoring means for restoring the recoil member to its initial position. Braking means brake the movement of the recoil member during recoil. The braking means are inoperative or of reduced effect during the recoil movements relative to all the shots in the burst other than the first shot.

19 Claims, 21 Drawing Figures

Figures 1, 1A:
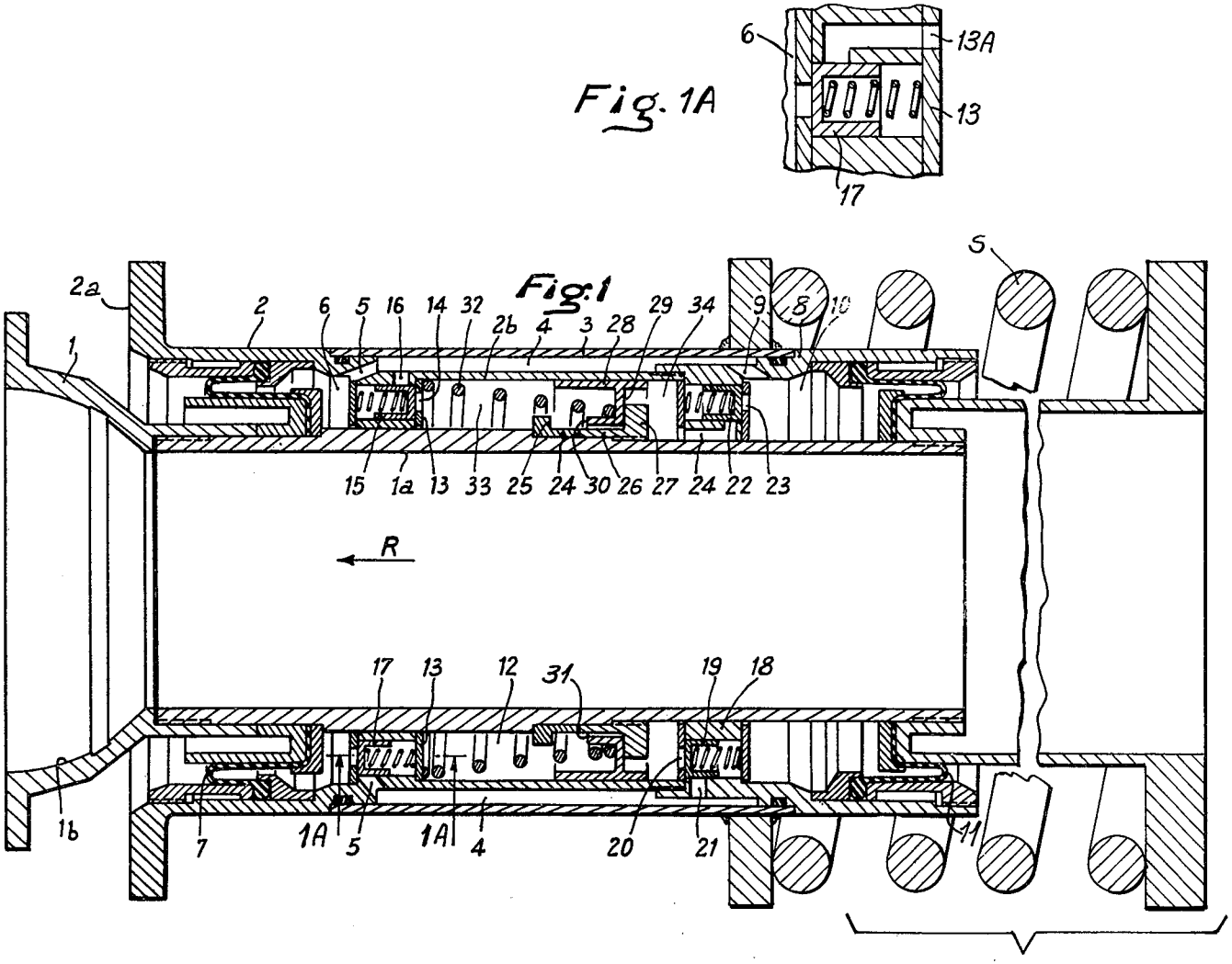

R 101
127
126
129
139
136
138
102

101
127
126
129
136
102
139

101
127
126
106
136
138
102

SHOCK ABSORBER FOR FIREARMS AND THE LIKE

The present invention relates to a shock absorber device which serves to connect an oscillating member subject to a sudden recoil, such as a weapon which fires in bursts, to a support such as a mounting, whereby the said device returns the said member to its initial position at the end of the burst. This device is more particularly usable for absorbing or damping the recoil of weapons such as guns mounted on aircraft.

The weapon firing in bursts on which the device according to the invention is to be used has a return spring such that shots are not fired after the return to the initial position of the weapon after recoil but instead during the return movement in such a way that the force of inertia brought about by this return movement opposes the recoil force produced by shots other than the first shot in the burst. In other words, the second shot in the burst is fired during the return movement to the initial position and successive shots in the burst are fired under the same conditions so that the weapon only returns to its initial position after the final shot in the burst has been fired.

A large number of shock absorber devices for weapons and particularly automatic weapons are already known. These devices generally comprise means for braking the weapon during recoil and elastic restoring means for returning the weapon to the initial position, whereby additional braking means can optionally be provided which also ensure braking during the return to the initial position.

The said known devices function throughout the burst in such a way that they are rapidly worn and also transmit considerable forces to the structure supporting the weapon.

The aim of the present invention is to provide a shock absorber device which obviates these disadvantages and permits the satisfactory operation of such a weapon whilst operating in a reliable manner and being simple and economic to manufacture. The invention also proposes, as improvements, to ensure the absorbing or damping of weapons carried by light-weight structures, for example, aircraft structures in such a way that the maximum stresses on the structure are reduced to the minimum.

The invention has for its object a shock absorber device for oscillating members such as automatic weapons firing in bursts wherein the shots in a burst, except for the first shot, are fired during the return of the weapon to its initial position, whereby the said device comprises a fixed member or support which is to be fixed to a structure, a recoiling member receiving or constituting part of the weapon and axially movable between a rest position and an extreme recoil position, elastic restoring means placed between the said fixed member and the said recoiling member for returning the said recoiling member to the initial position after recoil and braking means placed between the fixed member and the recoiling member to brake the latter during the recoil movement, wherein the said braking means are inoperative or at least have a reduced effectiveness during the recoil movements for the shots in the burst with the exception of the first shot.

According to a first simple embodiment of the invention the recoil braking means are arranged in such a way that braking is only ensured during a first portion of the total recoil travel and become inoperative during the remainder of the recoil travel, whereby the shots following the first shot in the burst are fired with the weapon located in a position within the said remainder of the recoil travel.

In the case, for example, where the braking means comprise hydraulic shock absorbing means consisting of a volume of fluid decreasing during recoil so as to expel the fluid through constrictions, it is advantageous to provide a valve whose opening is controlled by the recoil of the weapon at the end of the first part of the recoil in order to permit an easy outflow of fluid from the chamber without it being necessary to pass via the constrictions during the remainder of the recoil movement.

However, this embodiment of the invention is not preferred because as the braking course is reduced to a first part of the recoil movement for the first shot in a burst, it is necessary to provide more powerful braking so that higher maximum stress values are transmitted to the structure whereon is mounted the support member.

Thus according to a preferred embodiment of the invention, the braking means are constructed so as to be effective during the major part or the whole of the recoil after the first shot, whereby means are provided to make the said braking means inoperative or at least of a reduced effectiveness after the first shot of the burst.

According to a first variant of this second embodiment the braking means form a chamber preferably arranged in an annular manner between the support and the recoiling member, the said chamber being sub-divided into a front chamber and a rear chamber being variable in directions opposite to one another by means of a sliding piston co-operating with a seat on the recoiling member, restoring means being provided drawing the said piston towards the said seat, the said piston being taken away by the said seat during recoil. Constriction means are also provided to permit the outflow of fluid from the rear chamber to the front chamber when the fluid of the rear chamber is compressed by the recoiling sliding piston.

Thus, when at the first shot the recoiling member draws the sliding piston rearwards, whereby the said piston is applied against the recoiling seat by restoring means whereby the volume of the rear chamber is decreased and the fluid driven back therefrom, brakes via the constriction the recoil movement. When at the end of the recoil movement the restoring means move the recoiling member forwards, the sliding piston is only subject to the action of its restoring member which only permits it to move slowly forwards in opposition to the fluid whilst the seat carried by the recoiling member is moved away much more quickly in the forwards direction under the influence of the powerful restoring means of the recoiling member. Preferably, the sliding piston is entered with a clearance forming a connection between the two chamber portions and whereof the size is a function of the desired return speed of the piston.

Consequently, if a second shot is fired whilst the recoiling member moves in the forward direction towards its initial position, the seat is removed from the piston in such a way that no braking takes place after the second shot and the following shots.

To ensure braking, it is advantageously possible to provide a suitably calibrated valve to ensure the outflow of fluid from the rear chamber during recoil by means of a pipe which also issues into the front chamber optionally via a second valve.

According to a variant of the invention it is also possible to provide means which do not completely eliminate braking during firing in bursts but which decrease this braking to a predetermined value. In this embodiment, it can be advantageously brought about by providing a calibrated valve which preferably operates in both directions on the said seat. During the time that the piston is applied to the seat, the fluid cannot pass through the seat valve and maximum braking is obtained. When the piston is removed from the seat during firing in bursts, the movement of the said seat brings about a passage of the fluid via the seat valve in such a way as to obtain reduced braking.

According to a second variant of the preferred embodiment of the invention, braking is during recoil ensured by one or more friction members comprising a friction surface which are applied against the recoiling member under the influence of a wedging member which permits the clamping of the said surface against the recoiling member during recoil and the release of the surface during the return movement to the initial position. According to the invention, means are provided to prevent the operation of the said frictin member during recoil following any shot in a burst other than the first shot.

These means can advantageously comprise an axially sliding member which can be displaced during the return movement of the weapon to prevent the production of the wedging clamping effect ensuring the friction.

According to a special embodiment of the invention, this member can comprise a bush which can axially slide on the recoiling member and to this end has a ramp which can co-operate with a complementary ramp of a second bush which can both slide axially on the recoiling member and pivot on the said member in opposition to a return spring, a supplementary ramp being provided in the said second bush to co-operate with complementary means on the weapon.

The second bush can also have a slot co-operating with a pin on the recoiling member, whereby the said slot has a width greater than that of the pin over part of its length. During recoil, the rearwardly moving pin penetrates the wider portion of the slot and under the influence of the spring the said second bush pivots as a function of the slot width displacing the first bush in a forwards direction. This pivoting of the second bush is maintained during part of the forward return and if at this time a shot is fired, the advanced position of the second bush prevents the operation of the wedge-shaped braking members. If no supplementary shot is fired, the pin which co-operates with the narrowest portion of the slot returns the bush to its initial position in such a way that the first bush moves back and for the next shot which starts a new burst the braking means are located in the operating position.

The said braking means preferably comprise a plurality of wedge-shaped segments provided with a friction surface and co-operating with a bush having an internal frustum-shaped surface positioned around the said segments, whereby the said bush is preferably drawn forwards by elastic means in such a way that during recoil the compression of the said spring increases the friction force up to equilibrium between the said force and the degree of compression of the spring. The said spring can be advantageously supported on the fixed support in such a way that the friction force remains substantially constant. As a variant, the spring can be supported on the movable portion which when moving rearwards brings about a decrease in the spring compression proportional to the recoil and therefore a progressive decrease in the friction.

Moreover, the wedge-shaped friction segments can advantageously comprise a shoulder which can abut against a support stop in order to limit the possible movement of the friction member and consequently the maximum friction values.

According to an improvement of the invention, supplementary braking means can be provided to ensure braking during the return movement to the initial position and in this case means are provided to eliminate or at least limit this braking during a first part of the return travel during which another shot is liable to be fired.

In the case of the hydraulic construction these braking means can comprise the same chamber sub-divided into a front and rear chamber and a supplementary seat is then provided which can be applied against the rear face of the sliding piston in order to move the fluid in the front chamber towards the rear chamber via constrictions, whereby the said rear seat is separated from the front seat by a distance which is sufficient to ensure that during the return movement to the initial position the rear seat does not come in contact with the rear face of the piston until part of the return travel has been performed during which time a shot is liable to be fired.

In the second construction it is advantageously possible to provide wedge-shaped friction members co-operating with a wedge-shaped control member, being preferably arranged in symmetrical manner relative to the recoil braking members.

Means are then provided to prevent the braking effect occurring during the first part of the return travel, whereby these means can advantageously comprise a bush which is moved rearwardly by a spring and which can prevent the forwards movement of the friction members, whereby means are provided on the recoiling member to move the said bush forwards when the said first portion of the return travel has been completed. These means can advantageously comprise a pin or projection on the recoiling member which can move in a groove internal of the bush.

In a variant of the second embodiment, the braking means placed between the fixed member and the recoiling member for braking the recoiling member during the recoil movement act on a moving element which axially slides on the recoiling member between two stops carried by the said recoiling member, whereby one of the said stops drives the said moving element during the first recoil movement and the other stop returns the said element forwards towards its initial position on completion of the first part of the return travel.

The braking means acting on the said moving element can be of a different type. They can, for example, be hydraulic braking means. However, according to a preferred embodiment of the invention, the braking means comprise friction braking means.

Thus, according to an especially advantageous embodiment, the moving element has a smooth surface in the axial direction whereon act the friction surfaces of one or more wedge-shaped friction members which co-operate with a complementary wedge-shaped member in such a way that the recoil of the recoiling member, whilst driving the said moving element causes the jamming of the wedge-shaped members against the complementary member and thus friction on the moving element.

According to an especially preferred embodiment, the device according to the invention can be applied in such a way that it permits as desired different firing rates, for example, one slower and the other faster. In this embodiment the elastic restoring means placed between the fixed member and the recoiling member are operated in such a way as to have a different rigidity as a function of the means for controlling the device according to the invention. Preferably, these restoring means comprise two independent elastic members, whereby one of these members can be made inoperative, thus ensuring a change in the rigidity if, during the return movement in the forward direction the recoiling member traverses a predetermined distance before the following shot. Advantageously, to control the action of these elastic members the device can comprise a sliding bush co-operating both with the moving element between the stops and with means for attaching to and detaching from the said recoiling member.

Other advantages and characteristics of the invention can be gathered from reading the following description relative to a non limitative example with reference to the attached drawings wherein show:

FIG. 1 a schematic view in axial section of a device according to the invention.

FIG. 1A is a partial sectional view taken along the line 1A–1A of FIG. 1.

Figure 2:
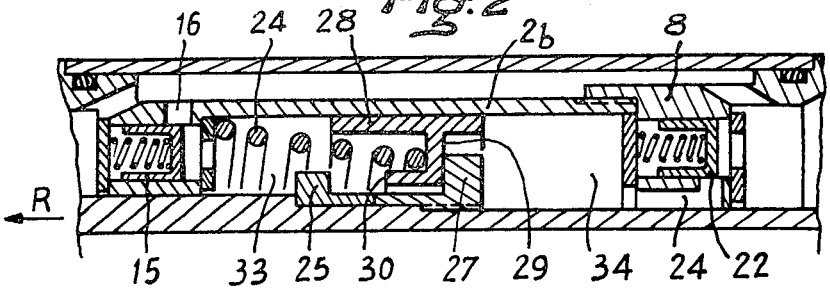
Figure 3:
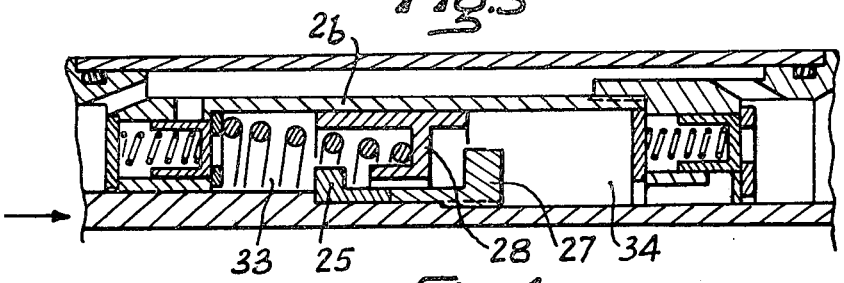
Figure 4:
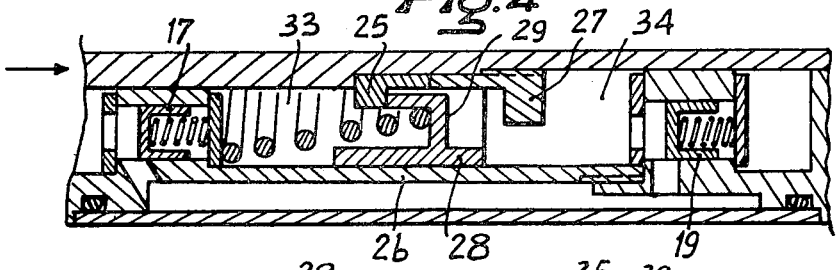

FIGS. 2, 3 and 4 a view of the chamber of the said device for different positions of the recoiling member.

Figure 5:
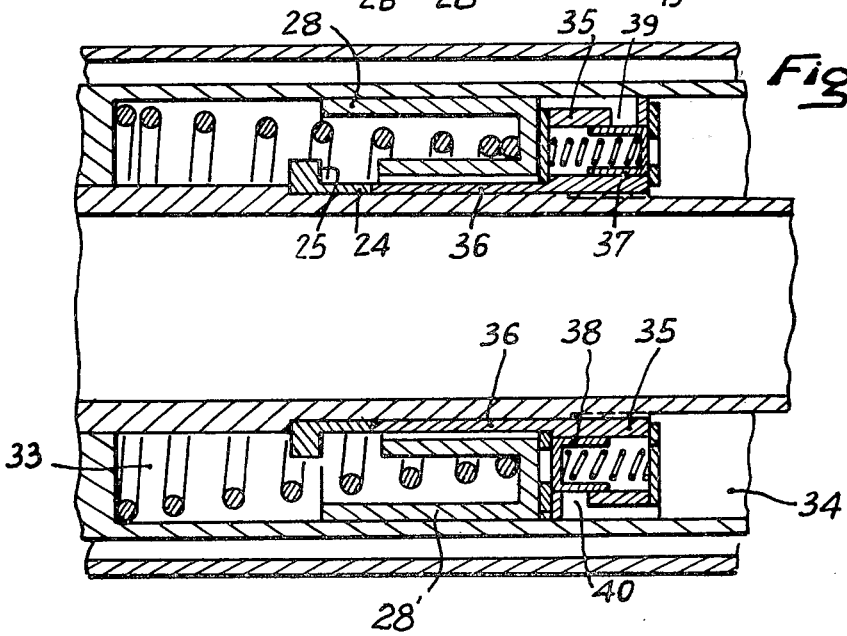

FIG. 5 a partial view in axial section of a device according to a variant of the invention.

Figure 6:
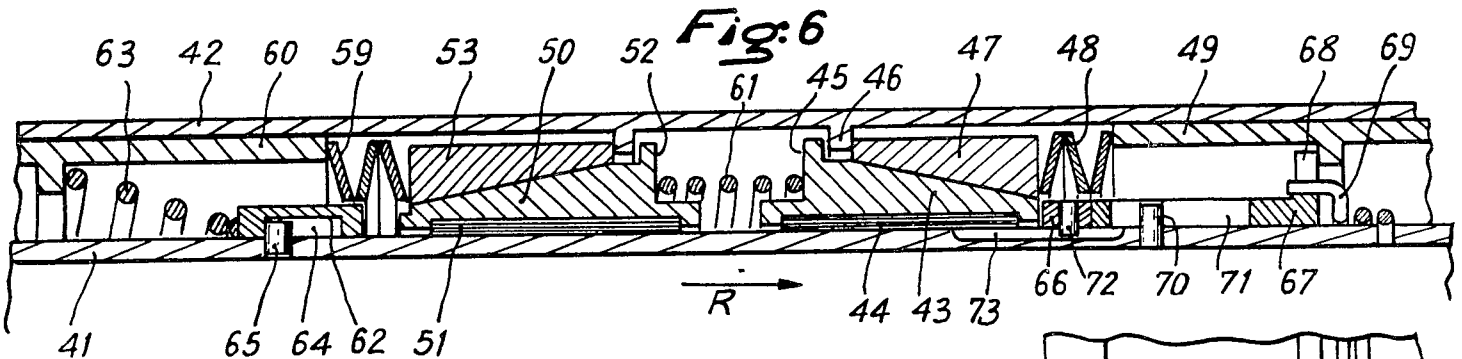

FIG. 6 an axial sectional view of a device according to another embodiment.

Figure 7:
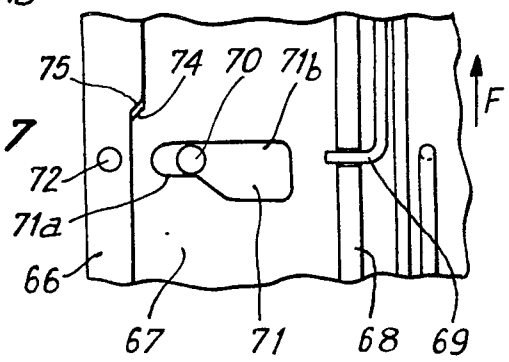

FIG. 7 a partial plan view of the rear bush of FIG. 6.

FIGS. 8 to 11 analogous views to FIGS. 6 and 7 for different positions of the recoiling member.

Figure 12:
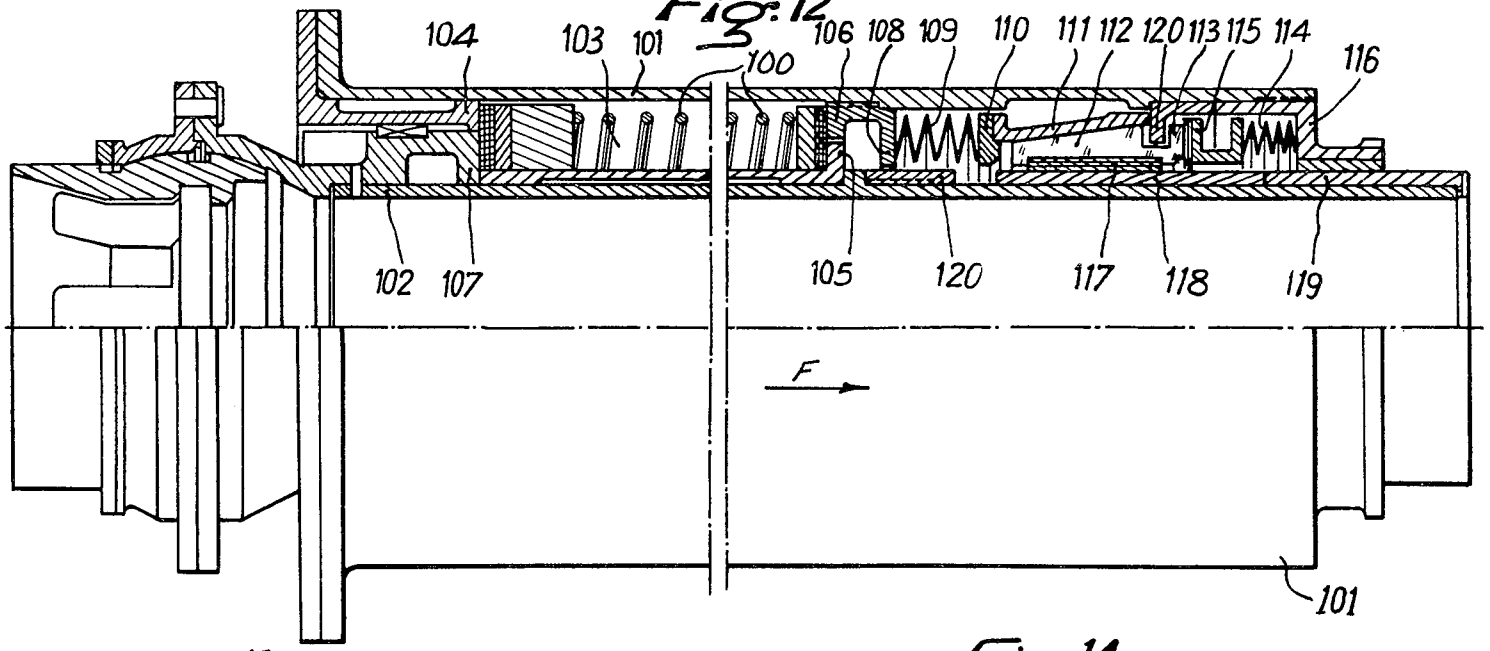

FIG. 12 an axial sectional view of a device having a moving element.

Figure 13:
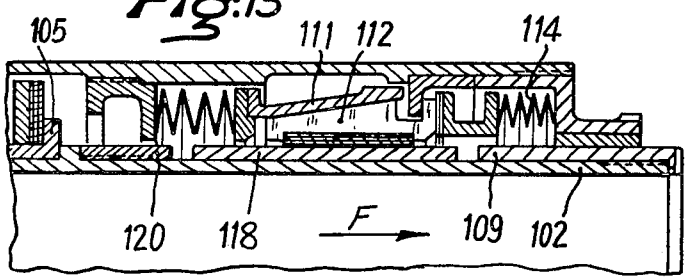

FIG. 13 a part axial sectional view according to FIG. 12, during operation in bursts.

Figure 14:
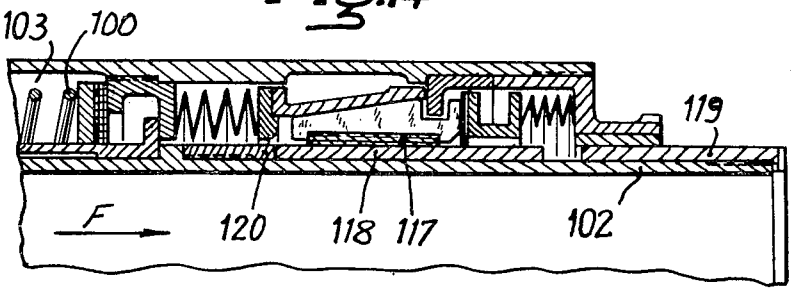

FIG. 14 a part axial sectional view of the device of FIG. 12.

Figure 15:
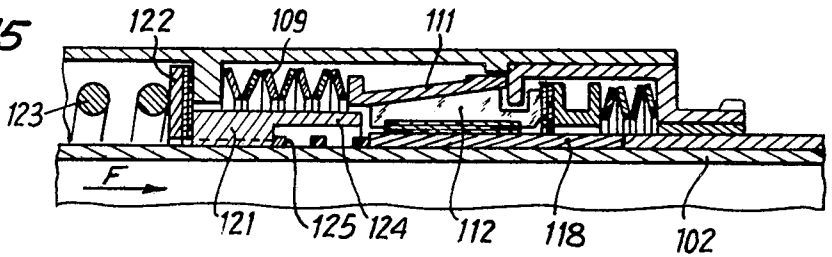

FIG. 15 a view of a device analogous to FIG. 12 but with means limiting the degree of movement at the end of the forwards return movement.

Figure 16:
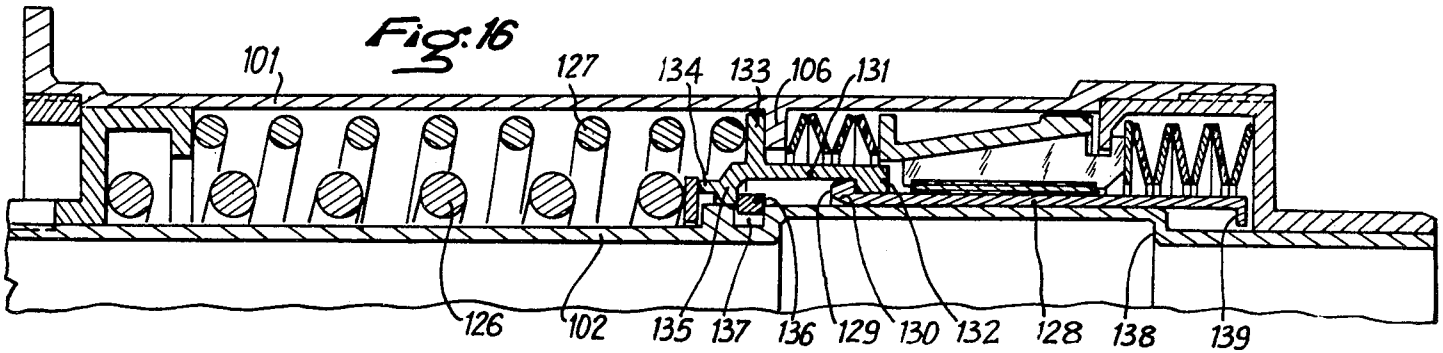

FIG. 16 a view of a device with differentiation between the elastic return means.

FIGS. 17 to 20 partial views of the device of FIG. 16 during operation.

On referring to FIGS. 1 to 4, the device shown comprises a generally cylindrical recoiling member 1 having a genuinely cylindrical portion 1*a* and a swivel bearing 1*b* for receiving a weapon such as a gun mounted on an aircraft. A generally cylindrical member 2 with a flange 2*a* is carried by the aircraft structure and contains within it the portion 1*a* of the recoiling member which is able to slide axially within the fixed support constituted by member 2. A central cylindrical portion 2*b* of member 2 forms with a peripheral sleeve 3 an elongated annular chamber 4 connected via holes 5 with an annular chamber 6 defined by member 2, whereby member 1 and diaphragm joint 7 seal the annular chamber 6 despite the axial movements of member 1 relative to support 2.

The other end of annular chamber 4 is closed by a fixed member 8 representing an extension of member 2 and having holes 9 connecting chamber 4 with a front chamber 10 which is also sealed by a diaphragm 11 identical to diaphragm 7. Between fixed member 2*b* and at the outer surface of the cylindrical portion 1*a* is provided an annular chamber 12 closed at its rear end by a washer 13 having a hole 14 which is normally sealed by a non-return valve 15 operated by an appropriate spring and located in a recess in member 2. When moved back, valve 15 permits the connection of hole 14 with opening 16 issuing into chamber 4. Washer 13 has a second hole 13*a* which co-operates with non-return valve 17 which is sensitive to the pressure in chamber 6 and which, when moved back, connects chamber 4 with the inside of chamber 12. The front portion of the said chamber 12 is sealed by an inner ledge 18 of member 8 having a first recess for a non-return valve 19 which, when it is moved back, permits the passage of fluid from chamber 12 by an opening 20 to chamber 4 by second opening 21. A diametrically opposed second recess makes it possible to receive a nonreturn valve 22 connected via opening 23 with chamber 10 and via opening 24 with chamber 12.

To portion 1*a* of the recoiling member is fixed a rear bush 24 provided with a ledge 25, whereby the said bush 24 is extended in the forward direction by a second bush 26 provided with a ledge 27, whereby bush 26 is also rigidly fixed to the recoiling member. Moreover, within chamber 12 is provided an annular sliding piston 28 whose front face 29 co-operates with ledge 27 whilst its rear face co-operates with ledge 25. As can be seen in the drawing, there is a certain diametral clearance 31 between piston 28 and bushes 24 and 26. This clearance is determined as a function of the rigidity of spring 32, the dimensions of the piston and the fluid viscosity so that the slow piston return speed can be set to the desired value. Piston 29 is moved forwards by spring 32 whose tension is considerably less than that of the elastic restoring means which ensure the return to the initial position of the recoiling member after firing. Spaces 4, 6, 10 and 12 are filled with oil.

The position shown in FIG. 1 corresponds to the rest position prior to firing when piston 29 is applied against seat 27 by spring 32. In this position a first shot is fired. Recoiling member 1 then moves rearwards in the direction of recoil shown by arrow R in opposition to the elastic restoring means. As can be seen from the intermediate position shown in FIG. 2, during recoil the rear chamber 33 of chamber 12 is progressively reduced whilst the front chamber 34 is increased. The pressure within chamber 33 therefore tends to increase and contributes to the firm application of piston 29 against seat 27. Moreover, when the pressure has reached a certain value, the calibrated valve 15 opens and fluid escapes from the chamber 33 and via opening 16 reaches chamber 4 and from there on forcing the passage through valve 22 again reaches front chamber 34. This way, an hydraulic damping or braking is obtained throughout recoil.

When recoiling member 1 has reached the extreme recoil position (not shown) its restoring means force it forwards in an opposite direction to arrow R and the recoiling member then rapidly moves forward again towards its initial position. In turn, sliding piston 28 is only moved forwards by its weak spring 32 and as a result of the resistance offered by the fluid only moves slowly. In fact, when compared with the considerable forward speed of the recoiling member, piston 28 remains substantially in position and seat 27 is removed from the piston. The passage is free between chambers 33 and 34 via clearance 31 in such a way that no damping takes place and this continues until as a result of the continuing advance of recoiling member 1 the ledge or rear seat 25 comes into contact with the rear face 30 of the piston. At this time, the piston is moved forward by the recoiling member and the direct passage between chambers 33 and 34 is sealed. The pressure then rises within chamber 34 which brings about the opening of valve 19 and the expulsion of fluid from chamber 34 which, via openings 20 and 21 passage 4 and valve 17 which opens, again reaches chamber 33 as can be seen in FIG. 4. When the recoiling member has returned to its initial position shown in FIG. 1, piston 28 slowly moves forwards under the influence of spring 32 and progressively returns to the position shown in FIG. 1 and another shot can be fired.

However, the weapon mounted in recoiling member 1 is designed to fire in bursts in such a way that after a first shot fired as described hereinbefore, the second shot of the burst is fired when, in a first return phase, seat 27 is desengaged from piston 28 but when rear seat 25 is still at a certain distance from the rear face 30 of piston 28, this position being shown in FIG. 3. Thus, this second shot interrupts the advance of the recoiling member and in fact attempts to move the recoiling member rearwards but with a reduced force due to the inertia of the recoiling member and the weapon which rapidly moves forwards at the time of the second shot. During this further recoil, the sliding piston has still not substantially moved so that it is not in contact with the seats, chambers 33 and 34 remain constant and no braking occurs. The restoring means again move the recoiling member in the forwards direction at the end of the said second recoil and whilst still in the position as shown e.g. in FIG. 3 the third shot of the burst if fired still without any damping.

After the final shot in the burst, the return movement of recoiling member 1 to its initial position is not interrupted by a shot so that it continues and finally seat 25 takes over rear face 30 of the sliding piston. Thus, there is a return to the position of FIG. 4 until the recoiling member returns to its initial position.

Obviously, different variants are possible within this embodiment and in particular the shape and arrangement of the different members can be modified so as to be more easily accessible or regulatable on the outside.

Reference should now be made to FIG. 5 where piston 28 is supported against a front seat 35 comprising a ledge extending from a bush 36 and having two diametrically opposed recesses occupied respectively by two non-return valves arranged in inverse manner 37, 38. The valves, moved back by their springs normally seal two passages 39, 40. During the recoil following the first shot, piston 28' is maintained against seat 35 and the not shown valves permit the evacuation of the fluid externally of chamber 33. However, when firing in bursts and as shown hereinbefore, piston 28' is removed from seats 35 and 25 in such a way that chamber 34 is sub-divided into two parts by seat 35 and the fluid circulates between these two parts through valve 38 during recoil and through valve 27 during forward movement, whereby the calibration of these valves makes it possible to ensure braking during the burst, this braking being advantageously limited to a relatively low value.

In the second embodiment shown in FIGS. 6 to 11 the recoiling member 41 which recoils in the direction of arrow R under the effect of a shot slides axially within a fixed support 42 whereof only a cylindrical portion is shown. On the periphery of recoiling member 41 are provided a plurality of friction members 43 each of which extends over a sector of a circle and has a wedge-shaped cross-section with an inclined plane whose inner surface carries a friction coating 44. Furthermore, member 43 has a shoulder or stud 45 which can abut against an inner interruption 46 of support 42. All the members 43 are arranged within a ring 47 which is subject to the action of spring 48 constituted by cupped washers and which is supported on a portion 49 integral with support 42.

A plurality of braking members 50 are arranged symmetrically relative to the diametral plane. Members 50 are similar to members 43 and are provided with a friction surface 51, a stud or ledge 52 and co-operate with a peripheral bush 53 having a frustum shaped inner surface drawn rearwards by a spring 59 comprising washers and supported on a portion 60 of support 42. A relatively weak spring 61 is placed between the two studs 45 and 52.

A bush 62 slidingly mounted on recoiling member 41 is moved rearwards by a spring 63 supported on portion 60. Bush 62 has an inner groove 64 within which can move a pin 65 on member 41.

On the back are provided a first and second bush 66, 67, whereby bush 67 has a stud 68 with a notch in which penetrates the end 69 of a spring which rotates bush 67 in the direction of arrow F. In the initial position shown in FIG. 6 and 7, the rotation of bush 67 is prevented by a pin 70 integral with recoiling member 41, which enters a slot 71 of bush 67. Slot 71 has a front portion **71*a* whose width is slightly greater than the width of the pin 70 and a wider portion 71*b* whereby the said two portions 71*a* and 71*b* are interconnected by an inclined edge. Bush 66 is immobilized by a pin 72 thereon and which enters an axial groove 73 made in recoiling member 41. Bush 67 has on its forward portion a ramp 74 facing which is normally located a ramp 75 of bush 66. Thus when bush 67 rotates in the direction of arrow F, ramp 74 acts with ramp 75 to move bush 66** in the forward direction.

Figure 8:
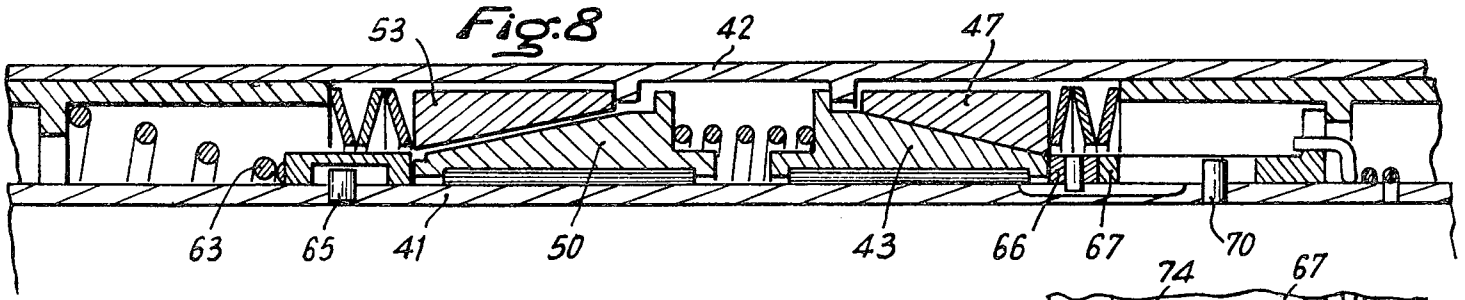
Figure 9:
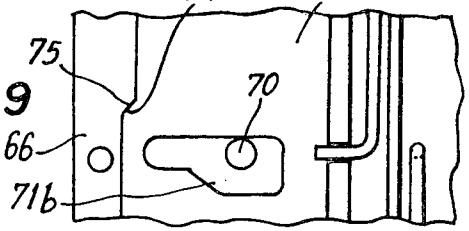

When a shot is fired the recoiling member 41 tends to recoil in the direction of arrow R. The friction members 50 are driven rearwards by the recoiling member and are detached from conical bush 53, the weak spring 61 being unable to oppose this movement. Thus the position of FIGS. 8 and 9 is reached representing an intermediate recoil position where members 50 have substantially no friction action. Before the end of the recoil movement, bush 62 is brought into contact with the forward end of members 50 and contributes to maintaining them spaced from bush 53.

However, members 43 which tend to recoil jam in bush 47 which in turn tends to recoil under this effect but encounters the significant resistance of spring 48 so that throughout recoil a substantially effective braking is obtained. Moreover, stud 45 limits the possibility of members 43 engaging in bush 47 so that any danger of chattering is avoided. Moreover, due to the recoil, pin 70 enters the wide portion of slot 71 as shown in FIG. 9. Spring 69 attempts to rotate bush 67 in the direction of arrow F but is prevented from doing so by the fact that stop 74 strikes against stop 75 of bush 66 which can hardly move forward because the presence of friction members 43 which are vigorously urged rearwards.

Figure 10:
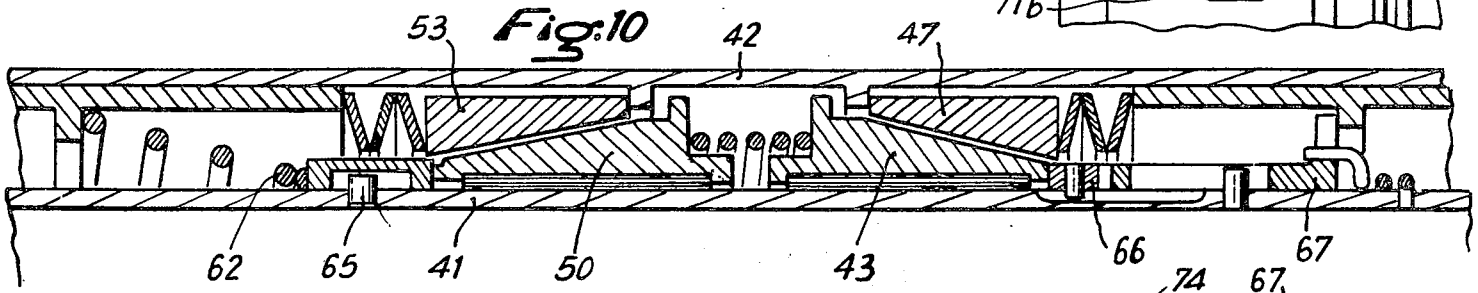
Figure 11:
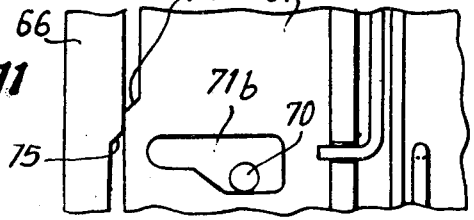

At the end of recoil, recoiling member 41 advances in the opposite direction to arrow R tending to drive members 43 in a forward direction whereby the latter become disengaged from bush 47 and no longer exert their friction action. Bush 66 then no longer meets any resistance from members 43 so that bush 67 can rotate in the direction of arrow F and consequently move bush 66 in a forwards direction which in turn pushes members 43 further forwards out of the range of bush 47, as shown in FIGS. 10 and 11. This position is maintained in the time that pin 70 is maintained in the wide portion 71*b* but as from the time when it meets the narrowed portion of slot 71 it again rotates bush 67 but in the direction opposite to arrow F so that bush 66 is no longer moved in the forwards direction by bush 67.

Simultaneously, during the forwards return members 50 are urged forwards in the direction of bush 53 by recoiling member 41. During the first portion of the forward return movement, this displacement of members 50 is prevented because bush 62 pushes members 50 rearwards away from bush 53. It is only after a first return movement phase, which is a function of the width of groove 64 that pin 65 comes into contact with the forward edge of the groove and at this time moves bush 62 forwards in opposition to spring 63. Members 50 can then move forwards and come into contact with bush 53, ensuring that their friction force is maintained substantially constant by the thrust of spring 59. At the end of firing the different members of the shock absorber device are located in the position shown in FIG. 6.

If, after firing a first shot, a second shot of the burst is fired at the time when a recoiling member has only completed a first part of its return travel and during which the braking of members 50 is inoperative because bush 62 has not yet been moved forwards, a recoiling member interrupts its forward travel and again moves rearwards. However, at the time when this second shot is fired, bush 67 is in the rotated position and bush 66 is moved forwards and in this position shown in FIGS. 10 and 11 members 43 are prevented from recoiling and cannot therefore co-operate with bush 47 to provide the friction force. Thus recoil takes place without friction as does the forward movment following this second recoil during which a third shot of the burst is fired and so on.

Thus with the device described, baking is ensured throughout the recoil following the first shot. It is interrupted during a first portion of the forward return travel during which the second shot of the burst is fired. It is interrupted during the recoil following the burst and throughout the remainder of the burst. When the final shot has been fired braking takes place during the second portion of the return travel back to the initial position.

It can be easily seen that in the various constructions there is no wear to the members during the burst of firing because damping is prevented, with the exception of the construction of FIG. 5 where there is slight damping during the burst.

Reference is now made to FIGS. 12 to 14 where the device according to the invention has the fixed member 101 serving as a support. Within member 101 is located recoiling member 102 which is axially guided by member 101. Between member 101 and member 102 is positioned the elastic restoring member 100 in an emplacement 103 which is supported on the one hand against a surface 104 of the fixed member and on the other against a surface 105 of the moving member.

It is also possible for forward supporting surfaces 106 of the fixed member and rearward supporting surfaces 107 of the recoiling member to act on the restoring member. During the forward return movement in the direction of arrow F supporting surfaces 104 and 105, which moved closer together through compressing the restoring member during the recoil movement, again move apart during the forward movement in the direction of arrow F and return to the position shown in FIG. 12. As a result of inertia, member 102 continues to move forward and the restoring member is then compressed between supporting surfaces 106 and 107 which damps the return movement to the initial position and it is only after a certain compression of the restoring member that the latter relaxes and finally brings the device into the position of FIG. 12.

Support 101 also has a supporting surface 108 whereon is supported the rear end of a spring 109 formed from cupped washers. Its forward portion spring 109 is supported against a stud 110 on an annular bush 111 having a frustum shaped inner surface which widens towards the front. Annular bush 111 can move freely in the axial direction between support 101 and member 102.

Within bush 111 are provided a certain number of members 112 in the form of a sector of a circle and which are wedge-shaped as shown in the drawings. At the front of the said members 112 is provided stud 113 against which is supported a return spring 114 set be means of a small bush 115, whereby spring 114 is itself supported on the stop 116 of member 101.

Each member 112 has its friction surface 117 arranged axially in contact with an elongated cylindrical bush 118 serving as the moving element. Element 118 can slide axially without significant friction relative to recoiling member 102 and move between a forward stop 119 and a rearward stop 120 of the said member 102.

The device functions as follows

Starting from the rest position shown in FIG. 12 the gun fires a first shot. The recoiling member then starts to recoil in the direction opposite to arrow F. In its recoil movement, its stop 119 drives rearwardly moving element 118. By friction the latter drives rearwards wedge-shaped members 112 which on coming into contact with bush 111 pushed back by its spring are jammed against moving element 118 so that there is intense friction between element 118 and friction surfaces 117 of members 112. During this recoil movement, the rearward movement of members 112 is limited by the fact that stud 113 is supported on stop 120 on fixed member 1. Members 112 can recoil no further so that the friction force is determined by the thrust of spring 109 against wedge-shaped bush 111, the said thrust remaining substantially constant so that a substantially constant force is transmitted to the aircraft structure.

Friction continues substantially to the end of the recoil movement of member 102 when the return spring at 103 is compressed to the maximum between supporting surfaces 104 and 105.

At the end of recoil, this restoring member relaxes and moves the recoiling member forwards in the direction of arrow F. During this movement members 112 are disengaged from the frustum-shaped bush 111 and no friction takes place. The moving element 118 which was constantly moved rearwards during the recoil movement by stop 119 remains substantially stationary in its recoil position corresponding to the end of the recoil movement. Stop 119 is then moved away from moving element 118 and stop 120 moves towards the said moving element. Following on the first part of the forward return movement stop 120 comes into contact with moving element 118 moving the latter forwards in the direction of arrow F.

As described hereinbefore, the forward return movement in the direction of arrow F continues beyond the rest position shown in FIG. 12 and the restoring member is then compressed between stops 106 and 107. This forward movement beyond the rest position makes it possible for stop 120 to move element 118 up to its rest position. FIG. 14 shows the position reached at the end of this forward return movement where the moving element is located in its initial position. The extreme forward movement is then reached and the restoring member decompresses and moves the recoiling member rearwards. Stop 120 moves away from element 118 which remains stationary and stop 119 moves towards it until it comes in contact therewith. A recoiling member which then only has a small kinetic energy stops because of the time where stop 119 comes into contact with element 118, members 112 exert a friction.

As a variant it is possible to regulate stops 119 and 120 and the restoring member in such a way that the moving element 118 is brought forward beyond the rest position in FIG. 12 so that during the slight recoil movement terminating the forward return movement, stop 119 moves towards element 118 and moves it rearwards with friction against members 112 until the rest position of FIG. 12 is reached.

As described hereinbefore, during the first part of the return movement into the initial position in the direction of arrow F, element 118 is not in contact with either of the stops 119 and 120 and this is the case during the forward travel of the recoiling member corresponding to the difference between the distance separating stops 119 and 120 and the length of the moving element 118.

If, however, during this first part of the return movement into the initial position a second shot is fired just before stop 120 has rejoined moving element 118, the return is interrupted and member 102 again starts to recoil.

Part of the recoil energy due to this second shot is compensated by the kinetic energy of which member 102 was advancing at the time when the second shot was fired and it is therefore desirable not to brake member 102 after the said second shot. In accordance with the invention no braking occurs as a result of a second shot being fired by the gun because stop 119 is removed from moving element 118 at the time when this occurs. The recoil movement of member 102 then continues until the return spring in emplacement 103 is compressed to the maximum which occurs at roughly the time when stop 119 comes into contact with moving element 118. The return spring then relaxes and moves member 102 forwards, whereby moving element 118 has still not moved since the end of the recoil movement due to the first shot being fired.

Obviously, it is then possible to fire a third shot just before stop 119 rejoins element 118 and so on, whereby firing in bursts takes place without moving element 118 transmitting any braking force to recoiling member 102.

Following the final shots, stop 120, following a first portion of its travel, meets moving element 118 and brings it to the initial position as described hereinbefore.

Any other construction of the braking means co-operating with the moving element 118 remains within the scope of the invention. Thus, for example, it is possible to use hydraulic braking means, e.g. providing element 118 with a radial flange extending outwardly and serving as a piston, moving within a sealed chamber on fixed member 101, whereby the said piston divides the chamber into two. The recoil movement of element 118 then displaces the fluid located inside of the rear face of the piston through constrictions towards the front chamber thus producing a braking. However, the said braking is suppressed during the recoil movement relative to any shot in a burst other than the first because stop 119 is then removed from moving element 118.

Reference is now made to FIG. 15 where member 120 is replaced by a member 121 integral with recoiling member 102 and which co-operates with a ring 122 which receives the end of return spring 123. Spring 109 supported on member 111 is located peripherally relative to member 121 having an extension 124 directed towards the end of the wedge-shaped members 112. A weak rectangular spring 125 is placed between the forward end of member 121 and the rear end of moving element 118. During recoil all the members 102, 118, 125 recoil without however changing their respective positions. During the return movement to the initial position following the firing of the first shot in the burst, the space between the rear end of the moving element 118 and the front end of member 121 is progressively reduced and the weak spring 125 compressses. When the turns of spring 125 are touching, member 121 which continues its forward movement with recoiling member 102 displaces element 118 to the right as indicated hereinbefore. On arriving again at the initial position of FIG. 15 towards the end of the recoil movement or more precisely just beyond the said initial position, member 124 is supported on members 112 in such a way that all friction is eliminated. Spring 125 relaxes and returns element 118 to its initial position. It could be readily understood that it is only necessary to exceed the rest position during the forwards return by an extremely small amount or even not exceed it at all in order to permit extension 124 to eliminate any friction which can exist as a result of member 112.

In the embodiment of FIG. 16 to 20 two concentric return springs, namely a first spring 126 and a second less rigid spring 127 are placed between recoiling member 102 and fixed support 101. Moreover, a moving element 128 is provided which fulfills substantially the same function as element 118 having a stop 139 co-operating with a complementary stop 138 of member 102. Stop 139 fulfils the same function as stop 120 in the case of FIG. 12.

The rear end of element 128 has an attachment head 129 with an internal chamber 130. Head 129 permits the attachment of a sliding bush 131 by means of an attachment head 132 which co-operates with head 130. Sliding bush 131 also has a peripheral flange 133 whereof one of the faces co-operates with stop 106 and whereof the other face receives the thrust of spring 127. Furthermore, bush 131 has an end 134 receiving the thrust of spring 126 as well as an inner ledge 135 which abuts against elastic ring 136 partly located in a groove 137 of member 102. It can in fact be concealed in the said groove but tends to be partly emergent under the action of it elasticity as shown in FIG. 16.

Figure 17:
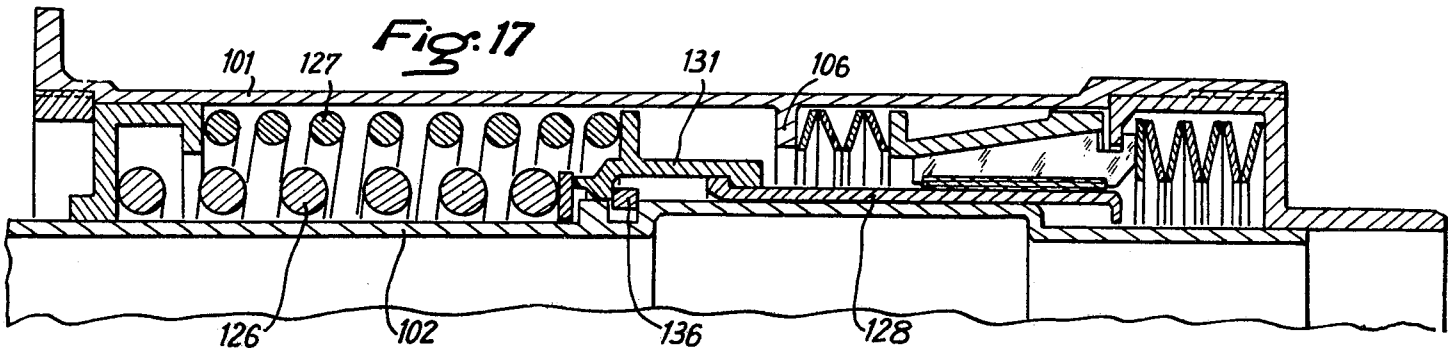
Figures 18, 19, 20:
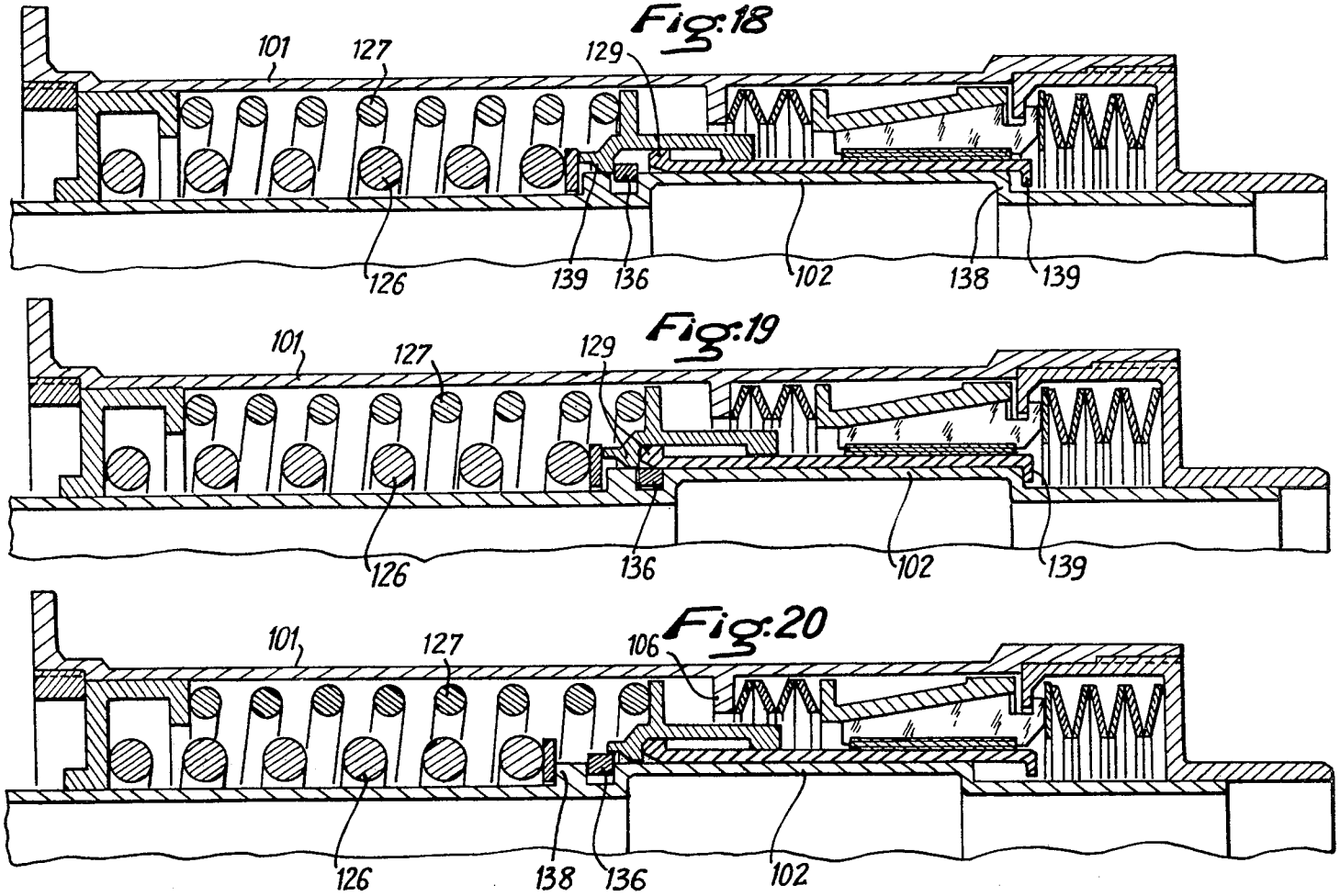

When, from the rest position shown in FIG. 16 a first shot is fired, recoiling member 102 recoils compressing springs 126 and 127 until the extreme recoil position shown in FIG. 17 is reached. In this position, bush 131 is driven by recoiling member 102 via the partially emerged ring 136. Starting from the position shown in FIG. 17 recoiling member 102 again starts to advance to the right and FIG. 18 shows the position wherein the clearance between stops 130 and 129 has clearly decreased. If, in this position, a second shot in the burst is fired the recoiling member again recoils but then moves forward again and so on, as described relative to the previous embodiments.

If instead of firing the second shot of the burst in a position such as that of FIG. 18, one waits until the forward return movement has continued somewhat, the clearance between stops 138 and 139 further decreases and as shown in FIG. 19 at the end of a certain time with member 131 moving closer to element 128, ramp 130 comes into contact with ring 131 concealed within groove 137.

If in this position, the second shot of the burst is fired, recoiling member 102 but as in this case the ring 136 is concealed, member 102 does not displace member 131 in its rearward movement. In fact member 131 urged by its spring 127 maintained by head 130 remains substantially stationary. Under these conditions, the thrust of spring 127 is no longer transmitted to recoiling member 102 which is only subject to the thrust of spring 126 by means of an appropriate stud 138. Thus as a result of the invention if the shots in a burst are fired in relatively rapid succession, i.e. before the return travel has been sufficient to conceal the ring 136, the member operates with the two recovery springs 126 and 127. If, however, the shots in a burst are fired at a slower rate providing a return travel which is adequate to conceal ring 136, only spring 126 will function effectively so that the invention makes it possible to adapt the rigidity of the elastic return members to the firing rate.

What we claim is:

1. In a shock absorber device for automatic weapons firing in bursts wherein all the shots in a burst with the exception of the first shot are fired during the return movement into the initial position of the weapon, which device comprises a support member, a recoiling member which is axially movable relative to said support member from a rest position to an extreme recoil position, elastic restoring means between said support member and said recoiling member for bringing said latter into said rest position, and braking means placed between said support member and said recoiling member for braking the latter during the recoil movements caused by the first shot of a burst, said braking means having at most a reduced effectiveness during the recoil movements caused by all the other shots of said burst, the improvement wherein said braking means comprise force transmitting means carried on said recoiling member for sliding movement between a front abutment on said recoiling member and a rear abutment on said recoiling member, and means for causing said force transmitting means to move, when between said abutments, at a lower speed than that at which it moves when in contact with one of said abutments during movement of said recoiling member.

2. A device according to claim 1 which comprises at least two elastic restoring members which are independent of one another and means for making inoperative at least one of the said elastic members when the return travel between two successive shots in a burst exceeds a certain predetermined position.

3. A device according to claim 2 which comprises a sliding bush receiving the action of the said restoring means, concealable means for transmitting the thrust of the recoiling member to the said bush and vice-versa and concealing means for effecting the said concealment starting from the said predetermined position.

4. A device according to claim 3, wherein the said sliding bush has a stud co-operating with a split ring concealable in a groove of the recoiling member under the action of a ramp and the said moving element, whereby the said sliding bush has means for attaching to the said moving element.

5. A device as claimed in claim 1 in which said braking means comprises a hydraulic chamber divided into a front chamber and a rear chamber by a sliding piston constituting said force transmitting means to that movement of said piston varies the volumes of said front and rear chambers, constriction means being provided to permit the flow of liquid between said front and rear chambers when said piston is urged against one of said abutments.

6. A device according to claim 5, wherein the return speed of the sliding piston is determined by a clearance connecting the front and rear chambers.

7. A device according to claim 5 also comprises a rear seat carried by the said recoiling member and which co-operates with the rear face of the sliding piston, whereby the latter can be moved forwards by the said rear seat after a certain time lag.

8. A device according to claim 5, wherein the said chamber has at its two ends calibrated non-return valves ensuring the circulation from one chamber portion to the other.

9. A device according to claim 5, wherein one of the said abutments has at least one calibrated non-return valve for a passage in one direction.

10. A device according to claim 9, wherein the said seat has a second passage with a non-return valve arranged in the opposite direction.

11. A shock absorber as claimed in claim 1 wherein said force transmitting means comprises at least one member having a friction surface to which force is applied by a wedging device.

12. A device according to claim 11, wherein a weak elastic member is placed between the said recoiling member and the said force transmitting to bring the latter into the initial position at the end of the return movement, comprising means provided for making the said friction means inoperative during the action of the said weak elastic member.

13. A device according to claim 11 which comprises means for braking the return to the initial position comprising at least one friction member which is applied against the said recoiling member under the action of a wedging device during the return to the initial position and wherein it comprises a bush which can slide on the recoiling member and is moved rearwards by a spring in order to make the said wedging device inoperative as well as means for moving the said bush in opposition to the spring after a certain time lag during the return movement.

14. A device according to claim 13, wherein the said means comprises a pin integral with the recoiling member co-operating with a wider groove of the bush.

15. A device according to claim 11 which the said wedging device comprises a bush having an internal frustum-shaped surface co-operating with the frustum-shaped surfaces of the friction members and moved in the locking direction by elastic means.

16. A device according to claim 15, wherein the said friction members have a stud able to co-operate with a support stop.

17. A device according to claim 11, in which comprises an axial sliding member which can be displaced during the return movements of the weapon to provide the operation of the said wedging device.

18. A device according to claim 17, wherein the said axial sliding member comprises an immobilized sliding bush which co-operates with a second bush which can slide on the recoiling member and pivot on the said member under the action of a return spring, whereby the second bush has a ramp which can co-operate as a result of the pivoting action with a ramp on the first bush in order to move the said first bush in a forwards direction.

19. A device according to claim 18, wherein the said second bush comprises a slot co-operating with a pin of the recoiling member, whereby the said slot has towards the front portion or limited width which prevents the rotation of the bush followed by a wider portion permitting the rotation of the bush after a first recoiling phase.

* * * * *